252-99 AU 166 EX
1/23/79 XR 4,136,051

United States Patent [19]
Saran et al.
[11] 4,136,051
[45] Jan. 23, 1979

[54] POURABLE WASHING COMPOSITIONS CONTAINING A LUMINOSILICATES AND NON-IONICS AND METHOD FOR THEIR PREPARATION

[75] Inventors: Herbert Saran, Dusseldorf-Holthausen; Peter Krings, Krefeld; Milan J. Schwuger, Haan Rhld.; Heinz Smolka, Langenfeld, all of Germany

[73] Assignee: Henkel Kommanditgesellschaft auf Aktien (Henkel KGaA), Dusseldorf-Holthausen, Germany

[21] Appl. No.: 814,046

[22] Filed: Jul. 8, 1977

Related U.S. Application Data

[63] Continuation-in-part of Ser. No. 549,177, Feb. 12, 1975, abandoned.

[30] Foreign Application Priority Data

Feb. 25, 1974 [AT] Austria ..... 1514/74

[51] Int. Cl.[2] ..... C02B 1/44; C11D 3/12; C11D 3/39; C11D 17/06

[52] U.S. Cl. ..... 252/91; 252/89 B; 252/97; 252/98; 252/99; 252/113; 252/131; 252/134; 252/140; 252/179; 252/540; 252/DIG. 1; 427/220

[58] Field of Search ..... 252/89, 99, 131, 140, 252/179, 113, 116, 120, 134, 174, 540, 559, DIG. 1, 97, 98, 91; 427/220

[56] References Cited

U.S. PATENT DOCUMENTS

| | | | |
|---|---|---|---|
| 3,033,641 | 5/1962 | Thomas | 423/329 |
| 3,254,034 | 5/1966 | Dwyer | 252/430 |
| 3,755,180 | 8/1973 | Austin | 252/99 |
| 3,769,222 | 10/1973 | Yurko | 252/89 |
| 3,789,002 | 1/1974 | Weber | 252/99 |
| 3,868,336 | 2/1975 | Mazzola | 252/527 |
| 3,894,960 | 7/1975 | Gray | 252/99 |
| 3,932,316 | 1/1976 | Sagel | 252/532 |
| 3,985,669 | 10/1976 | Krummel | 252/116 |
| 4,071,377 | 1/1978 | Schwuger | 252/89 X |

FOREIGN PATENT DOCUMENTS

| | | | |
|---|---|---|---|
| 813581 | 10/1974 | Belgium | 252/131 |
| 2422655 | 11/1974 | Fed. Rep. of Germany | 252/131 |
| 2433485 | 6/1975 | Fed. Rep. of Germany | 252/131 |

OTHER PUBLICATIONS

D. W. Breck: Zeolite Molecular Sieves, published by John Wiley & Sons, New York, 1974, pp. 502 & 503.

*Primary Examiner*—Dennis L. Albrecht
*Attorney, Agent, or Firm*—Hammond & Littell

[57] ABSTRACT

Pourable washing agent compositions comprising essentially a premix powder component and optionally a second powder component obtained by hot drying of an aqueous composition containing conventional heat-insensitive components, consisting essentially of (1) from 30% to 100% by weight of a premix consisting essentially of (A) finely-dispersed, water-insoluble silicate compounds having a calcium-binding power of at least 50 mg CaO/gm of anhydrous active substance and having the formula, combined water not shown, of $$(M_{2/n}O)_x \cdot Me_2O_3 \cdot (SiO_2)_y$$

where M is a cation of the valence n, exchangeable with calcium, x is a number of from 0.7 to 1.5, Me is a member selected from aluminum and boron and y is a number of from 0.8 to 6, which silicate compounds optionally are partly replaced by highly dispersed silica in amounts of not more than 4% by weight, based on the weight of the premix;

(B) optionally bleaching components selected from the group consisting of inorganic peroxyhydrate compounds capable of supplying $H_2O_2$ in water, activators for percompounds, stabilizers for percompounds and mixtures thereof;

(C) non-ionic surface-active compounds finely distributed on and throughout component (A) or the mixture of components (A) and (B);

where the mixture of component (A) to component (C) is in the ratio of 10:1 to 1:3; and (2) from 0 to 70% by weight of a powdery component obtained by hot drying of an aqueous composition containing conventional heat-insensitive washing components; as well as a process for the production of said pourable washing compositions.

1 Claim, No Drawings

POURABLE WASHING COMPOSITIONS CONTAINING A LUMINOSILICATES AND NON-IONICS AND METHOD FOR THEIR PREPARATION

REFERENCE TO PRIOR APPLICATION

This application is a continuation-in-part of application Ser. No. 549,177, filed Feb. 12, 1975, and now abandoned.

In the production of powdered washing and cleansing agent compositions, non-ionic surface-active compounds (Non-ionics) are frequently used in addition to or instead of the anionic surface-active compounds. According to a technically preferred production method, the aqueous mixture of the components of the preparation is transformed into a pourable powder by hot drying, particularly by atomization in a hot gas. Since the Non-ionics are steam-volatile, a part thereof is lost in the above hot drying. This is undesirable for economical and ecological reasons. In order to avoid these losses, it is desirable to incorporate the Non-ionics into a preliminary mixture by spraying them on powdered substrates, which represent themselves conventional components of solid washing and cleaning agent compositions, such as sodium tripolyphosphate, sodium perborate or sodium sulfate. These preliminary mixtures can then be admixed with the remainder of the components. However, the premixes obtained in this manner have unsatisfactory powder qualities of the Non-ionics portion in the premix exceeds 10% by weight of the total premix. Therefore, with a premix portion of about 50% by weight in the total detergents, which is conventional, only 5% by weight of Non-ionics can be incorporated in the end product.

It is also known to improve the powder quality of these premixes by the addition of other substrates with a large active surface area, such as highly dispersed silica, but in this matter, wash-inactive ballast materials are introduced into the washing composition. In addition, sodium triphosphate as a solid substrate should be avoided, likewise for ecological reasons.

In the copending, commonly assigned Application Ser. No. 800,308, filed May 25, 1977, which is a continuation-in-part of Application Ser. No. 458,306, filed Apr. 5, 1974 and now abandoned, an improvement in the process of washing and bleaching textiles is described wherein the solid textiles are immersed in an aqueous solution containing a water softening agent for a time sufficient to disperse or dissolve the soil from said soiled textiles into said aqueous solution, separating said aqueous solution and recovering said textiles substantially soil-free. This improvement consists of using at least one finely-dispersed water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence n, exchangeable with calcium x is a member of from 0.7 to 1.5, Me is a member selected from the group consisting of aluminum and boron, and y is a number from 0.8 to 6, as said water softening agent.

The calcium binding power of the silicate compounds can be as high as 200 mg CaO/gm of anhydrous active substance (AS) and preferably is in the range of 100 to 200 mg CaO/gm AS.

The cation M employed is preferably sodium. However the same can also be totally or partially replaced by other cations exchangeable with calcium, such as lithium, potassium, ammonium or magnesium, as well as by the cations of water-soluble organic bases, for example, by those of primary, secondary or tertiary alkylamines or alkylolamines with not more than 2 carbon atoms per alkyl radical, or not more than 3 carbon atoms per alkylol radical.

An object of the present invention is to develop a preferably phosphate-free or low-phosphate pourable detergent containing non-ionic surface-active compounds, which do not have the above-described disadvantages and where a loss of Non-ionics is avoided in the production.

Another object of the present invention is the development of a pourable washing agent composition comprising a premix powder component and optionally a second powder component obtained by hot drying of an aqueous composition containing conventional heat-insensitive washing agent components, consisting essentially of (1) from 30% to 100% by weight of a premix powder component consisting essentially of (A) at least one finely-dispersed, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence n, exchangeable with calcium, x is a number of from 0.7 to 1.5, Me is a member selected from the group consisting of aluminum and boron, and y is a number from 0.8 to 6, which silicate compound can optionally be partly replaced with highly dispersed silica in an amount of not more than 4% by weight of the weight of the premix;

(B) from 0 to 80% by weight of the premix of bleaching components selected from the group consisting of inorganic peroxyhydrate compounds capable of supplying $H_2O_2$ in water, powdery acylated activators for percompounds, powdery stabilizers for percompounds and mixtures thereof;

(C) non-ionic surface-active compounds finely distributed on and throughout component (A) or the mixture of components (A) and (B);

where the mix ratio of component (A) to component (C) is in the ratio of 10:1 to 1:3 and at least 20% of said premix are components (A) and (C) together, the final mix ratio of the components being selected whereby the premix is a pourable powder; and (2) from 0 to 70% by weight of a second powdery component obtained by hot drying of an aqueous composition containing conventional heat-insensitive washing agent components.

Another object of the present invention is the development of a pourable premix powdery component for admixture in washing agent compositions consisting essentially of (A) at least one finely-dispersed, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence n, exchangeable with calcium, x is a number of from 0.7 to 1.5, Me is a member selected from the group consisting of aluminum and boron, and y is a number from 0.8 to 6, which silicate compound can optionally be partly replaced with highly dispersed silica in an amount of not more than 4% by weight of the weight of the premix;

(B) from 0 to 80% by weight of the premix of bleaching components selected from the group consisting of inorganic peroxyhydrate compounds capable of supplying $H_2O_2$ in water, powdery acylated activators for percompounds, powdery stabilizers for precompounds and mixtures thereof;

(C) non-ionic surface-active compounds finely distributed on and throughout component (A) or the mixture of components (A) and (B);

where the mix ratio of component (A) to component (C) is in the ratio of 10:1 to 1:3 and at least 20% of said premix are components (A) and (C) together, the final mix ratio of the components being selected whereby the premix is a pourable powder.

These and other objects of the invention will become more apparent as the description thereof proceeds.

The above drawbacks have been overcome and the above objects have been achieved by the present pourable washing agent compositions. The pourable washing and cleaning agents according to the invention consist of from 30% to 100% by weight of a premix composed of:

(A) at least one finely-dispersed, water-insoluble silicate compound containing combined water in the given case, having a calcium binding power of at least 50 mg CaO/gm of anhydrous active substance and the general formula (on the anhydrous basis)

$$(M_{2/n}O)_x \cdot Me_2O_3 \cdot (SiO_2)_y$$

where M is a cation of the valence n, exchangeable with calcium, x is a number from 0.7 to 1.5, preferably from 0.7 to 1.1, Me is aluminum or boron, and y is a number from 0.8 to 6, preferably from 1.3 to 4, where these compounds can likewise be substituted partly by highly dispersed silica in amounts of not more than 4% by weight based on the entire premix;

(B) optionally, a bleaching component of inorganic percompounds which supply $H_2O_2$ in water, and/or activators for these percompounds;

(C) Non-ionics finely distributed over the component according to (A) or over the mixture of components (A) and (B); and from 0 to 70% by weight of a powder component obtained by hot drying of an aqueous composition with conventional heat-insensitive components of washing and cleaning agents.

The premixes must, therefore, already be considered as washing and cleaning agent compositions in the sense of the invention.

The quantitative ratio of the cation-exchanging component (A) and of the Non-ionics (C) in the above-defined premix can be in the range of 10:1 to 3:1, depending on whether the substrates of component (B) are also present, whereby the cation exchanging compounds according to (A) and the Non-ionics (C) represent at least 10% by weight of the premix.

More particularly, the present invention resides in a pourable washing agent composition comprising a premix powder component and optionally a second powder component obtained by hot drying of an aqueous composition containing conventional heat-insensitive washing agent components, consisting essentially of (1) from 30% to 100% by weight of a premix powder component consisting essentially of (A) at least one finely-dispersed, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence n, exchangeable with calcium, x is a number of from 0.7 to 1.5, Me is a member selected from the group consisting of aluminum and boron, and y is a number from 0.8 to 6, which silicate compound can optionally be partly replaced with highly dispersed silica in an amount of not more than 4% by weight of the weight of the premix;

(B) from 0 to 80% by weight of the premix of bleaching components selected from the group consisting of inorganic peroxyhydrate compounds capable of supplying $H_2O_2$ in water, powdery acylated activators for percompounds, powdery stabilizers for percompounds and mixtures thereof;

(C) non-ionic surface-active compounds finely distributed on and throughout component (A) or the mixture of components (A) and (B);

where the mix ratio of component (A) to component (C) is in the ratio of 10:1 to 1:3 and at least 20% of said premix are components (A) and (C) together, the final mix ratio of the components being selected whereby the premix is a pourable powder; and (2) from 0 to 70% by weight of a second powdery component obtained by hot drying of an aqueous composition containing conventional heat-insensitive washing agent components.

The invention most particularly relates to a pourable washing agent composition comprising a premix powder component and optionally a second powder component obtained by hot drying of an aqueous composition containing conventional heat-insensitive washing agent components, consisting essentially of (1) from 30% to 100% by weight of a premix powder component consisting essentially of (A) at least one finely-dispersed, water-insoluble crystalline silicate compound wherein at least 80% by weight of the crystalline particles of said silicate compound have a size from 10μ to 0.01μ and having a calcium binding power of 100 to 200 mg CaO/gm of anhydrous active substance and the formula on the anhydrous basis $$(M_2O)_x \cdot Me_2O_3 \cdot (SiO_2)_y$$

where M is a cation selected from the group consisting of sodium and potassium, lithium and ammonium, x is a number of from 0.7 to 1.5, Me is a member selected from the group consisting of aluminum and boron, and y is a number from 1.3 to 4, which silicate compound can optionally be partly replaced with highly dispersed silica with a specific BETsurface of at least 250 $m^2$/gm in an amount of not more than 4% by weight of the weight of the premix;

(B) from 0 to 80% by weight of the premix of bleaching components selected from the group consisting of inorganic peroxyhydrate compounds capable of supplying $H_2O_2$ in water, powdery acylated activators for per-compounds, powdery stabilizers for per-compounds and mixtures thereof;

(C) non-ionic surface-active compounds finely distributed on and throughout component (A) or the mixture of components (A) and (B); by applying the liquid form of component (C) thereon; where the mix ratio of component (A) to component (C) is in the ratio of 10:1 to 1:3 and at least 20% of said premix are components (A) and (C) together, the final mix ratio of the components being selected whereby the premix is a pourable powder; and (2) from 0 to 70% by weight of a second powdery component obtained by hot drying of an aqueous composition containing conventional heat-insensitive washing agent components.

Therefore, the invention also resides in a pourable premix powdery component for admixture in washing agent compositions consisting essentially of (A) at least one finely-dispersed, water-insoluble silicate compound containing at least some combined water and having a calcium binding power of at least 50 mg CaO/gm of anhydrous active substance and the formula on the anhydrous basis $$(M_2/_nO)_x \cdot Me_2O_3 \cdot (SiO_2)_y$$

where M is a cation of the valence n, exchangeable with calcium, x is a number of from 0.7 to 1.5, Me is a member selected from the group consisting of aluminum and boron, and y is a number from 0.8 to 6, which silicate compound can optionally be partly replaced with highly dispersed silica in an amount of not more than 4% by weight of the weight of the premix;

(B) from 0 to 80% by weight of the premix of bleaching components selected from the group consisting of inorganic peroxyhydrate compounds capable of supplying $H_2O_2$ in water, powdery acylated activators for per-compounds, powdery stabilizers for per-compounds and mixtures thereof;

(C) non-ionic surface-active compounds finely distributed on and throughout component (A) or the mixture of components (A) and (B); where the mix ratio of component (A) to component (C) is in the ratio of 10:1 to 1:3 and at least 20% of said premix are components (A) and (C) together, the final mix ratio of the components being selected whereby the premix is a pourable powder.

The synthetic water-insoluble silicate compounds defined as component (A) will hereafter be called "aluminosilicates" forsimplicity's sake. Their calcium binding power can attain values of 200 mg CaO/gm of anhydrous active substance (AS) and is preferably in the range of 100 to 200 mg CaO/gm AS.

Sodium is preferably used as a cation, but it can also be replaced by lithium, potassium, ammonium or magnesium, as well as by the cations of water-soluble organic bases, for example, by those of primary, secondary or tertiary alkylamines or alkylolamines with not more than two carbon atoms per alkyl or not more than three carbon atoms per alkylol.

With particular advantage aluminosilicates are used which consist of at least 80% by weight of particles of a size from 10 to 0.01 μ, preferably from 8 to 0.1 μ. These aluminosilicates contain preferably no primary or secondary particles of a size above 40 μ.

The non-ionic surface-active compounds (Non-ionics) to be utilized according to the invention are the products of addition of 8 to 20 mols of ethylene oxide to 1 mol of a compound having from 10 to 20 carbon atoms and a labile hydrogen atom such as fatty alcohols, alkylphenols, fatty acids, fatty amines, fatty acid amides or alkanesulfonamides. Especially important are the purely aliphatic non-ionics derived, for example, from coconut or tallow fatty alcohols, from oleyl alcohol or from secondary alkanols with 12 to 18 carbon atoms.

In addition to these practically water-soluble Non-ionics, the water-insoluble or not readily water-soluble ethoxylation products with 2 to 6 mols of ethylene oxide to 1 mol of the above compounds having from 10 to 20 carbon atoms and a labile hydrogen atom are of interest because of their fat-dissolving and greying-inhibiting properties. If these are used together with the water-soluble Non-ionics and/or other surfactants, a good cleaning effect is achieved, particularly with hydrophobic soil, if the quantitative ratio in the finished detergent formulas of the low-ethoxylated Non-ionics to the higher ethoxylated Non-ionics is in the range of 1:3 to 2:1, particularly 1:2 to 1:1.

Particularly preferred, because of their good cleaning action in combination with a good biodegradability, are the ethoxylation products of the primary, straight-chained $C_{12}$ to $C_{18}$ alkanols or alkenols with an average degree of ethoxylation of 3 to 5 or 10 to 15, respectively, in the above-indicated quantitative ratios.

Also the products of addition of ethylene oxide to terminal or non-terminal vicinal alkanediols having from 10 to 20 carbon atoms can be used as non-ionic surface-active compounds, with 2 to 4 or respectively 8 to 14 ethyleneglycol ether units in the molecule being preferred.

Other suitable Non-ionics are those of the type of the acid amides which are obtained by reacting fatty acids, fatty acid esters, fatty acid halides or alkanesulfonic acid halides with mono- or diethanolamine or by further ethoxylation of these reaction products.

The invention thus concerns substantially the use of the finely divided, cation-exchanging aluminosilicates according to (A) as solid substrates with good adsorption power for the Non-ionics. This makes is not only possible to provide pourable washing and cleaing agent compositions with a high Non-ionics content, but it makes it unnecessary to a great extent to use conventional water-soluble inorganic or organic sequestering agents for calcium-ions, because of the excellent cation exchanger properties of the aluminosilicates. Phosphorus-containing calcium sequestering agents, particularly sodium tripolyphosphate, can be completely eliminated from the premix according to the invention and thus from the washing and cleaning agent compositions made therefrom.

The premixes suitable for the production of bleaching washing agent compositions contain as an additional solid substrate the bleaching component (B), which consists of an inorganic percompound or peroxyhydrate compound supplying $H_2O_2$ in water, particularly of sodium perborate and/or a solid activator for the percompound as well as a stabilizer for the percompound, and which can amount to from 15% to 80% by weight of the premix when the same is present. But component (B) can also consist exclusively of the activator for percompounds. In the latter case, three partial mixtures are used for the production of the bleaching preparations, namely, the activator-containing premix, a hot-dried powder, and the powdered percompound. In premixes for non-bleaching preparations, such as prewashing, fine washing or main washing agent compositions, component (B) is naturally missing.

The premixes according to the invention can also contain other conventional powdered components of washing and cleansing agent compositions. These include as a possible constituent of component (A) a highly dispersed silica with a specific BET-surface of at least 250 $m^2$/gm, which should be contain, however, only up to 4% by weight of the premix because of its nature as a ballast substance. The premixes containing a bleaching component (B) can also contain additionally a stabilizer, preferably magnesium silicate to enhance the bleaching action. Optionally, and in addition, the premixes can contain the following water-soluble substrates: sodium sulfate, the alkali metal carbonates, bicarbonates, silicates or borates, known as wash alkalis, or the water-soluble builders or sequestering agents described below; urea is also suitable as a substrate.

Substances, such as enzymes, antimicrobial compounds or perfumes, which are not subjected to hot drying because of their instability relative to water and/or heat, or because of their volatility can also be added in small amounts to the premixes.

The composition of a premix containing percompounds is generally within the following formula:

10% to 60% by weight of the aluminosilicates according to (A),

20% to 80% by weight of inorganic percompounds supplying $H_2O_2$ in water, particularly sodium perborate, 10% to 30% by weight of Non-ionics, 0 to 4% by weight of highly dispersed silica, 0 to 30% by weight of a powdered activator and/or stabilizer for percompounds, Premixes without percompounds can have the following composition:

60% to 90% by weight of the aluminosilicates according to (A),

10% to 40% by weight of Non-ionics, 0 to 4% by weight of highly dispersed silica, 0 to 30% by weight of a powdered activator for percompounds.

The above-defined aluminosilicates can be produced synthetically in a known, simple manner, for example, by reacting water-soluble silicates with water-soluble aluminates in the presence of water. To this end aqueous solutions of the starting materials can be mixed with each other, or one component which is present in solid form can be reacted with another component which is present as an aqueous solution. The desired aluminosilicates can also be obtained by mixing both solid components in the presence of water. Aluminosilicates can also be produced from $Al(OH)_3$, $Al_2O_3$ or $SiO_2$ by reaction with alkali metal silicate or alkali metal aluminate solutions, respectively. Finally, such substances are also formed from the melt, but this method seems of less economical interest because of the required high melting temperature and the necessity of transforming the melt into finely-dispersed products.

The cation-exchanging aluminosilicates to be used according to the invention are only formed if special precipitation conditions are maintained, otherwise products are formed which have no, or an inadequate, calcium exchanging power. The calcium exchanging power of at least 50 mg CaO/gm of anhydrous active substance (AS) is critical to the present process. If aluminosilicates are employed with below the critical limit of calcium exchanging power, very little if any soil removal from the soiled textiles is effected in the absence of other types of calcium sequestering or precipitating agents. The production of useable aluminosilicates according to the invention is described in the experimental part.

The aluminosilicates in aqueous suspension produced by precipitation or by transformation in finely-dispersed form according to other methods can be transformed from the amorphous into the aged or into the crystalline state by heating the suspension to temperatures of 50° to 200° C. However, there is hardly any difference between these two forms as far as the calcium binding power is concerned. Aside from the drying conditions, the calcium binding power of the aluminosilicates is proportional to the amount of aluminum contained therein with reference to the amount of silicon.

The preferred calcium binding power, which is in the range of 100 to 200 mg CaO/gm AS, is found primarily in compounds of the composition:

$$0.7 \text{ to } 1.1\ Na_2O \cdot Al_2O_3 \cdot 1.3 \text{ to } 3.3\ SiO_2$$

This summation formula comprises two types of different crystal structures (or their non-crystalline initial products) which also differ by their summation formulas. These are:

(a) $0.7 \text{ to } 1.1\ Na_2O \cdot Al_2O_3 \cdot 1.3 \text{ to } 2.4\ SiO_2$ (b) $0.7 \text{ to } 1.1\ Na_2O \cdot Al_2O_3 \cdot > 2.4 \text{ to } 3.3\ SiO_2$ The different cyrstal structures can be seen in the X-ray diffraction diagram. In X-ray amorphous products, the crystal structure can mostly still be recognized in an electron diffraction diagram.

A representative of type (A) above is the compound I of the composition:

$$0.9\ Na_2O \cdot Al_2O_3 \cdot 2.04\ SiO_2 \cdot 4.3\ H_2O \qquad (I)$$

A representative of type (B) above is compound II of the composition:

$$0.8\ Na_2O \cdot 1\ Al_2O_3 \cdot 2.65\ SiO_2 \cdot 5.2\ H_2O \qquad (II)$$

The water content of compounds I and II was determined after drying for 24 hours at 100° C.

The amorphous or crystalline aluminosilicate contained in the aqueous suspension can be separated by filtration from the remaining aqueous solution and be dried at temperatures of 50° C to 800° C, for example.

Depending on the drying conditions, the product contains more or less combined water. Anhydrous products are obtained by drying at 800° C. If we want to remove the water completely, this can be done by heating for 1 hour to 800° C. This is the way the AS contents of the aluminosilicates are also determined.

Such high drying temperatures are not recommended for the aluminosilicates to be used according to the invention, preferably the temperature should not exceed 400° C. It is of particular advantage that even products dried at substantially lower temperatures of 80° to 200° C, for example, until the adhering liquid water is removed, can be used for the purposes of the invention. The aluminosilicates thus produced, which contain varing amounts of combined water, are obtained after the disintegration of the dried filter cake, as fine powders whose primary paticle size does not exceed 0.1 mm, but is mostly lower and ranges down to dust fineness, for example, to 0.1 μ. It must be kept in mind that the primary particles can be agglomerated to larger structures. In some production methods primary particle sizes ranging from 50 to 1 μ are obtained.

Of particular advantage are aluminosilicates having at least 80% by weight of particles of 10 to 0.01 μ, preferably 8 to 0.1 μ. These aluminosilicates preferably contain no primary or secondary particles above 40 μ. As far as the products are crystalline, they are "microcrystalline."

The formation of smaller particle sizes can already be enhanced by the precipitation conditions. For these smaller particle sizes, the intermixed aluminate and silicate solutions, which can also be introduced simultaneously into the reaction vessel, are subjected to great shearing forces. If crystalline aluminosilicates are produced, which are preferred according to the invention, the formation of larger or inter-penetrating crystals is prevented by slowly stirring the crystallizing mass.

Nevertheless, undesired agglomeration of crystal particles can occur during the drying, so that it is advisable to remove these secondary particles in a suitable manner, for example, by air sifting. Aluminosilicates obtained in coarser form, which are ground to the desired particle size, can also be used. Suitable for this purpose are, for example, mills and/or air sifters or combinations thereof. The latter are described, for example, in Ullmann, "Enzyklopädie der technischen Chemie" vol. 1, 1951, p. 632 to 634.

From the sodium aluminosilicates, aluminosilicates of other cations, for example, those of potassium, magnesium or water-soluble organic bases can be produced in a simple manner by the exchange of bases.

In order to produce aluminosilicates I and II, the following conditions are employed.

PROCESS CONDITIONS

The aluminate solution, diluted with deionized water was mixed in a vessel of 15 liter capacity, under vigorous stirring with the silicate solution. Both solutions were at room temperature. An X-ray amorphous sodium aluminosilicate was formed in the exothermic reaction as a primary precipitation product. After stirring for 10 minutes, the suspension of the precipitation product was either separated as an amorphous product or transferred to a crystallization vessel where it remained for some time at the elevated temperature given to crystallize. After draining off the liquor from the crystals and washing with deionized water until the outflowing wash water had a pH-value of about 10, the filter residue was dried. When there is any deviation from this general production procedure, this is mentioned explicitly in the specific part. Thus, for example, in some cases for the practical tests, the homogenized uncrystallized suspension of the precipitation product or the crystal sludge was used. The water content was determined by heating the product for one hour to 800° C.

In the production of microcrystalline aluminosilicates, indicated by the suffix "m", the aluminate solution diluted with deionized water was mixed with the silicate solution and mixed in a high-speed intensive stirrer (10,000 rpm, "Ultraturrax", made by Janke & Kunkel IKA-Werk, Stauffen/Breisgau/Federal Republic of Germany). After vigorous stirring for 10 minutes, the suspension of the amorphous precipitation product was transferred to a crystallization vessel where the formation of large crystals was prevented by stirring the suspension. After draining off the liquor and washing with deionized water until the outflowing water had a pH value of about 10, the filter residue was dried, then ground in a ball mill and separated in a centrifugal sifter ("Microplex" air sifter, made by Alpine, Augsburg, Federal Republic of Germany) into two fractions, of which the finer fraction contained no portions above 10 μ. The particle size distribution was determined by means of a sedimentation scale.

The degree of crystallization of an aluminosilicate can be determined from the intensity of the interference lines of an X-ray diffraction diagram of the respective product, compared to the corresponding diagrams of X-ray amorphous or fully crystallized products.

All data in % are in percent by weight.

The calcium binding power of the aluminosilictes or borosilicates was determined in the following manner. 1 liter of an aqueous solution, containing 0.594 gm of $CaCl_2$ (= 300 mg CaO/1 = 30° dH) and adjusted to a ph of 10 with diluted NaOH, was mixed with 1 gm of the aluminosilicate or borosilicate (on the anhydrous basis, AS). Then the suspension was stirred vigorously for 15 minutes at a temperature of 22° C (± 2° C). After filtering off the aluminosilicate, the residual hardness x of the filtrate was determined. From it, the calcium binding power was calculated in mg CaO/gm. As according to the formula: (30 - x). 10 . For short hand purposes the above procedure is hereinafter referred to by the Calcium Binding Power Test Method.

If calcium binding power is determined at higher temperature, for example, at 60° C, better values are obtained than at 22° C. This fact distinguishes the aluminosilicates from most of the soluble sequestering agents that have been suggested so far for use in detergents and represents a particular technical process in their use.

| Production conditions for aluminosilicate I: | |
|---|---|
| Precipitation: | 2.985 kg of an aluminate solution of the composition: 17.7% $Na_2O$, 15.8% $Al_2O_3$, 66.6% $H_2O$<br>0.15 kg of sodium hydroxide<br>9.420 kg of water<br>2.445 kg of 25.8% sodium silicate solution of the composition 1 $Na_2O$. 6.0 $SiO_2$, prepared freshly from commercial waterglass and easily alkali-soluble silica |
| Crystallization: | 24 hours at 80° C |
| Drying: | 24 hours at 100° C |
| Composition: | 0.9 $Na_2O$ . 1 $Al_2O_3$ . 2.04 $SiO_2$ . 4.3 $H_2O$ (=21.6% $H_2O$) |
| Degree of crystallization: | Fully crystalline |
| Calcium binding | |

-continued

| Production conditions for aluminosilicate I: | |
|---|---|
| power: | 150 mg CaO/gm AS. |

If the product obtained was dried for 1 hour at 400° C, an aluminum silicate Ia was obtained of the composition:

$0.9\ Na_2O\ .\ 1\ Al_2O_3\ .\ 2.04\ SiO_2.\ 2.0\ H_2O$ (= 11.4% $H_2O$)

which is likewise suitable for the purposes of the invention.

| Product conditions for aluminosilicate II: | |
|---|---|
| Precipitation: | 2.115 kg of an aluminate solution of the composition: 17.7% $Na_2O$ 15.8% $Al_2O_3$, 66.5% $H_2O$<br>0.585 kg of sodium hydroxide<br>9.615 kg of water<br>2.685 kg of a 25.8% sodium silicate solution of the composition: 1 $Na_2O$. 6 $SiO_2$ (prepared as under I) |
| Crystallization: | 24 hours at 80° C |
| Drying: | 24 hours at 100° C and 20 torr. |
| Composition: | 0.8 $Na_2O$. 1 $Al_2O_3$. 2.655 $SiO_2$. 5.2 $H_2O$ |
| Degree of crystallization | Fully crystalline |
| Calcium binding power: | 120 mg CaO/gm AS. |

The aluminosilicates I and II show in the X-ray diffraction diagram the following interference lines.

| d- values, recorded with Cu-$K_\alpha$- radiation in A | |
|---|---|
| I | II |
| — | 14.4 |
| 12.4 | — |
| — | 8.8 |
| 8.6 | — |
| 7.0 | — |
| — | 4.4 (+) |
| 4.1 (+) | — |
| — | 3.8 (+) |
| 3.68 (+) | — |
| 3.38 (+) | — |
| 3.26 (+) | — |
| 2.96 (+) | — |
| — | 2.88 (+) |
| — | 2.79 (+) |
| 2.73 (+) | — |
| — | 2.66 (+) |
| 2.60 (+) | — |

It is quite possible that not all these interference lines will appear in the X-ray diffraction diagram, particularly if the aluminosilicates are not fully crystallized. For this reason, the d-values which are the most important for the characterization of these types are identified by a "(+)".

| Production conditions for aluminosilicate Im: | |
|---|---|
| Precipitation: | As in aluminosilicate I |
| Crystallization: | 6 hours at 90° C |
| Drying: | 24 hours at 100° C |
| Composition: | 0.9 $Na_2O$ . 1 $Al_2O_3$ . 2.05 $SiO_2$ . 4.3 $H_2O$ (= 21.6% $H_2O$) |
| Degree of crystallization: | Fully crystalline |
| Calcium binding power: | 170 mg CaO/gm AS |

The particle size of the aove described microcrystalline product Im, determined by sedimentation analysis, was in the following range:

| | | |
|---|---|---|
| >40 μ = | 0% | maximum range of the particle size |
| <10 μ = | 100% | destribution curve at 3 - 6 μ |
| > 8 μ = | 50-95% | |

All the above aluminosilicates I, II and Im as well as other are described in Ser. No. 2,800,308 and 458,306, incorporated herein by reference.

The cation-exchanging aluminosilicates can partly or completely replace the phosphorus-containing inorganic or organic calcium sequestering agents of the washing and cleansing agent compositions, especially sodium tripolyphosphate, so that the phosphorus concentration in the sewage is considerably reduced by using the preparation according to the invention instead of the known preparations with a high sodium tripolyphosphate content.

Among the percompounds serving as bleaching agents and releasing $H_2O_2$ in water, sodium perborate tetrahydrate ($NaBO_2$ . $H_2O_3$ . 3 $H_2O$) and the monohydrate ($NaBO_2$ . $H_2O_2$) are of particular importance, but also other $H_2O_2$-releasing borates can also be used, such as perborax $Na_2B_4O_7$ . 4 $H_2O_2$. These compounds can be replaced partly or completely by other carriers of active oxygen, particularly by peroxyhydrates, such as peroxycarbonates, ($Na_2CO_3$ . 1.5 $H_2O_2$) or peroxypyrophosphates.

It is recommended to incorporate water-insoluble stabilizers for the percompounds together with the latter. Water-insoluble stabilizers are, for example, magnesium silicate having a $MgO:SiO_2$ of 4:1 to 1:4, preferably 2:1 to 1:2, and particularly 1:1, which are mostly obtained by precipitation from aqueous solutions. In their place, other alkaline earth metal, cadmium or tin silicates or corresponding compositions are also usable. Also hydrous oxides of tin are suitable as stabilizers. The water-insoluble stabilizers and particularly magnesium silicate can be incorporated in the washing agent composition both in the premix according to the invention and in the atomization-dried powders, adding it is such amounts that the portion of the finished washing agent composition is from 1% to 4% by weight.

In order to obtain a satisfactory bleaching effect with the washing agent compositions containing percompounds at temperatures below 80° C, particularly in the range of 40° to 60° C, activators for the percompunds, particularly for perborate, can be incorporated in the preparations in the premix according to the invention. Preferred activators are those of the type of the N-acyl compounds which have a melting point of at least 70° C, preferably at 100° C, for example, the compounds N,N,N', N'-tetraacetylethylenediamine, tetraacetylglycoluril and tetrapropionylglycoluril. Particularly preferred as an acylated activator for percompounds is tetraacetylglycoluril, melting point 233° to 240° C, which is also suitable as a solid substrate and which has a good activating effect in amounts of 0.1 to 1 mol per gm-atom of activated oxygen of the percompounds. The premixes according to the invention can contain preferably from 15% to 25% by weight of an activator as part of component (B).

The invention also concerns a method for the production of the above-defined premixes, which is characterized in that the liquid Non-ionics are applied on a moving powder of the above-defined components according to (A) or on a powder mixture of the components (A) and (B), and that the premix product is mixed likewise with a powder in the pourable state, obtained by hot-drying of an aqueous composition consisting of heat-insensitive components of washing and cleansing agent compositions.

Preferably the liquid Non-ionics, or those liquefied by heating, are sprayed on the powder mixture, which is done possibly in a closed vessel. However, fluid bed methods can also be used.

Apart from the components of the premix, the finished washing and cleansing agent compositions can also contain the following components: anionic and/or non-ionic surface-active compounds or tensides, surface-active or nonsurface-active foam stabilizers or foam inhibitors, textile softening agents, neutral or alkaline reacting builder compounds, as well as auxiliary substances and additives which are present in small amounts, such as corrosion inhibitors, soil suspension agents, optical brighteners, dyes, etc.

The composition of a typical textile washing agent composition to be used in the washing temperature range of 30° C to 100° C is within the following formula:

5% to 30% by weight of anionic and/or non-ionic or amphoteric surface-active compounds;

5% to 70% by weight of water-insoluble, but water-containing, aluminosilicates of the definition indicated under (A);

2% to 45% by weight-soluble sequestering agents for calcium ions;

0 to 50% by weight of builder compounds not capable of sequestering calcium ions, particularly alkaline builder salts;

0 to 40% by weight of a bleaching component consisting of percompounds, particularly sodium perborate, and, optionally, stabilizers and/or activators;

0 to 10% by weight of other additives, which are mostly present in small amounts in textile washing compositions.

The pre-washing and main washing agent compositions of this formula contain no percompounds. In the full range washing agent compositions used preferably at high or boiling temperatures, the content of the bleaching component is 10% to 40% by weight.

The quantitative data refer to the entire formula, disregarding the fact that it consists of both a premix and a hot-dried powder in admixture. Individual components, particularly the aluminosilicates, can be present both in the premixes and the hot-dried component.

The washing and cleansing agent compositions obtained according to the invention are used preferably for washing textiles, but they can also be used for cleaning the surfaces of non-textile objects, particularly various household appliances.

Here follows a list of compounds in each of the above classifications which are suitable for use in the preparations according to the invention.

The anionic or amphoteric surface-active compounds or tensides contain in the molecule at least one hydrophobic organic moiety and one-water-solubilizing, anionic or amphoteric group. The hydrophobic moiety is mostly an aliphatic hydrocarbon radical with 8 to 26, preferably 10 to 22 and particularly 12 to 18, carbon atoms or an alkyl aromatic radical, such as alkylphenyl, with 6 to 18, preferably 8 to 16, aliphatic carbon atoms.

Among the anionic surface-active compounds are, for example, soaps of natural or synthetic, preferably saturated, fatty acids, optionally also, soaps of resinic or naphthenic acids. Suitable synthetic anionic tensides are those of the type of the sulfonates, sulfates and synthetic carboxylates.

Suitable anionic tensides of the sulfonate type are alkylbenzene sulfonates ($C_{9-15}$ alkyl) mixtures of alkenesulfonates and hydroxyalkanesulfonates, as well as alkanedisulfonates, as they are obtained, for example, from monoolefins with terminal or non-terminal double bonds by sulfonation with gaseous sulfur trioxide and subsequent alkaline or acid hydrolysis of the sulfonation products. Also suitable are alkanesulfonates which are obtained from alkanes by sulfochlorination or sulfoxidation and subsequent hydrolysis or neutralization or by bisulfite addition to olefins. Other suitable tensides of the sulfonate type are the esters of $\alpha$-sulfofatty acids, for example, the $\alpha$-sulfonic acids of hydrogenated methyl or ethyl esters of coconut, palmkernel or tallow fatty acids.

Suitable tensides of the sulfate type are the sulfuric acid monoesters of primary alcohols (e.g. from coconut fatty alcohols, tallow fatty alcohols or oleyl alcohol) and those of secondary alcohols. Also suitable are sulfated fatty acid alkanolamides, sulfated fatty acid monoglycerides or sulfated reaction products of 1 to 4 mols of ethylene oxide with primary or secondary fatty alcohols or alkylphenols.

Other suitable anionic tensides are the fatty acid esters or amides of hydroxy- or amino-carboxylic acids or sulfonic acids, such as the fatty acid sarcosides, fatty acid glycolates, fatty acid lactates, fatty acid taurides or fatty acid isoethionates.

The anionic tensides can be present in the form of their alkali metal salts, such as the sodium or potassium salts, the ammonium salts; as well as soluble salts of organic bases, such as the lower alkylolamines, for example, mono-, di- or triethanol amine.

The foaming power of the tenside can be increased or reduced by combination of suitable tenside types. A reduction can also be achieved by additions of non-surfaceactive organic substances.

A reduced foaming power, that is desirable for the use in washing machines, is often attained by combination of different tenside types, such as of sulfates and/or sulfonates with the nonionics, and/or with soaps. In soaps, the foam inhibition increases with the degree of saturation and the number of carbons in the fatty acid residue. Soaps derived from saturated $C_{20-24}$ fatty acids have been proven good as foam inhibitors.

The amphoteric surface-active compounds or tensides which can be employed particularly betaines containing a quadruple substituted, that is, quaternary ammonium group and a covalently-bound acid group, whose positive and negtive charges are balanced intramolecularly. The betaines have on the nitrogen at most two, but generally only one higher-molecular-weight aliphatic hydrocarbon radical of a hydrophobic nature, and at least one, but generally two, lower alkyl radicals with 1 to 3 carbon atoms, which can be substituted by hydroxyl groups or connected with each other directly or over a hetero atom. The anionic, water-solubilizing acid group is connected with the ammonium nitrogen over the fourth substituent, which consists mostly of a shortchained aliphatic radical having, optionally, a double bond or a hydroxyl group, such as an alkylene, hydroxyalkylene or alkenylene, all having from 1 to 3 carbon atoms. Typical representatives are, for example, the compounds:

3-(N-hexadecyl-N,N-dimethylammonio)-propane sulfonates, 3-(N-tallow-alkyl-N,N-dimethylammonio)-2-hydroxypropane sulfonates, 3-(N-hexadecyl-N,N-bis-[2-hydroxyethyl]-ammonio)-2-hydroxypropyl sulfate, and N-tetradecyl-N,N-dimethyl-ammonio-acetate.

Compounds can also be used for the purposes of the invention as sequestering agents for calcium with such a sequestering capacity that they were not considered heretofore as typical sequestering agents for calcium, but such compounds are frequently capable of delaying the precipitation of calcium carbonate from aqueous solution.

Among the sequestering agents are those of an inorganic nature, such as the alkali metal pyrophosphates, tripolyphosphates, higher polyphosphates and metaphosphates.

Organic compounds which are used as sequestering agents are found, as known, among the polycarboxylic acids, hydroxycarboxylic acids, aminocarboxylic acids, carboxyalkyl ethers, polyanionic polymers, and particularly the polymeric carboxylic acids and the phosphonic acids, these compounds being used mostly in the form of their water-soluble salts, such as their alkali metal salts.

Weakly acid, neutral or alkaline-reacting inorganic or organic salts can be used as builder salts as indicated above.

Suitable weakly acid, neutral or alkaline-reacting salts for use according to the invention are, for example, the bicarbonates, carbonates, borates or silicates of the alkali metals, alkali metal sulfates, as well as the alkali metal salts or organic, non-surface-active sulfonic acids, carboxylic acids and sulfocarboxylic acids containing from 2 to 9 carbon atoms. These include, for example, watersoluble salts of benzenesulfonic acid, toluenesulfonic acid or xylenesulfonic acid, water-soluble salts of sulfoacetic acid, sulfobenzoic acid or of sulfodicarboxylic acids, as well as the salts of acetic acid, lactic acid, citric acid and tartaric acid.

The preparations according to the invention can furthermore contain soil suspension agents or dirt carriers, which keep the dirt released from the fibers in suspension in the liquor and so prevent graying. Suitable compounds are water-soluble colloids, mostly of an organic nature, such as the water-soluble salts of polymeric carboxylic acids, glue, gelatin, salts of ether carboxylic acids or ether sulfonic acids of starch or cellulose, or salts of acid sulfuric acid, esters of cellulose or starch. Water-soluble polyamides containing acid groups are also suitable for this purpose. Furthermore, soluble starch preparations and other than the above-mentioned starch products can be used, for example, degraded starches aldehyde starches etc. Polyvinyl pyrrolidone can also be used.

The enzyme preparations to be used are mostly a mixture of enzymes with different effects, such as proteases, carbohydrases, esterases, lipases, oxidoreductases, catalases, peroxidases, ureases, isomerases, lyases, transferases, desmolases, or nucleases. Of particular interest are the enzymes, obtained from bacteria strains or from fungi, such as Bacillus subtilis or Streptomyces griseus, particularly proteases and amylases, which are relatively stable towards alkalis, percompounds, and anionic tensides and are still effective at temperatures up to 70° C.

Enzyme preparations are marketed by the manufacturers mostly as aqueous solutions of the active substances or as powders, granulates or as cold-sprayed products. They frequently contain sodium sulfate, sodium chloride, alkali metal ortho-, pyro- and polyphosphates, particularly tripolyphosphate, as fillers. Dust-free preparations are particularly valued. These are obtained in a known manner by incorporating of oily or pasty Nonionics or by granulation with the aid of melts of water-of-crystallization-containing salts in their own water-of-crystallization.

Enzymes may be incorporated which are specific for certain types of soil, for example, proteases or amylases or lipases. Preferably, combinations of enzymes with different effects are used, particularly combinations of proteases and amylases.

The washing agents can contain optical brighteners such as those for cotton, particularly derivatives of diaminostilbenedisulfonic acid or its alkali metal salts. Suitable are, for example, salts of 4,4'-bis-(2-anilino-4-morpholino-1, 3,5-triazin-6-yl-amino)-stilbene-2,2'-disulfonic acid or similarly compounds which have instead of the morpholino group, a diethanolamino group, a methylamino group or a 2-methoxyethylamino group. Brighteners for polyamide fibers which can be used are those of the type of the 1,3-diaryl-2-pyrazolines, for example, the compound 1-(p-sulfamoylphenyl)-3-(p-chlorophenyl)-2-pyrazoline, as well as compounds of similar composition which have instead of the sulfamoyl group, for example, the methoxycarbonyl group, the 2-methoxyethoxycarbonyl group, the acetylamino group or the vinylsulfonyl group. Suitable polyamide brighteners are also the substituted aminocumarins, for example, 4-methyl-7-dimethylamino-cumarin or 4-methyl-7-diethylaminocumarin. Furthermore, the compounds 1-(2-benzimidazolyl)-2-(1-hydroxyethyl-2-benzimidazolyl)-ethylene and 1-ethyl-3-phenyl-7-diethylamino-carbostyril can also be used as polyamide brighteners. Brighteners for polyester and polyamide fibers which can be used are the compounds 2,5-di-(2-benzoxazolyl)-thiophene,2-(2-benzoxazolyl)-naphtho-[2,3-b]-thiophene and 1,2-di-(5-methyl-2-benzoxazolyl)-ethylene. Furthermore, brighteners of the type of the substituted 4,4'-distyryl-diphenyls can be utilized, for example, the compound 4,4'-bis-(4-chloro-3-sulfostyryl)-diphenyl. Mixtures of the above-mentioned brighteners can likewise be used.

The following specific embodiments are illustrative of the invention without being limitative in any respect.

EXAMPLES

The aluminosilicate used in the examples has the following composition:

$$0.9\ Na_2O\ .\ Al_2O_3\ .\ 2.0\ SiO_2\ .\ 4\ H_2O$$

and a calcium binding power of 165 mg CaO/gm As. The particle size distribution was within the following range:

| | |
|---|---|
| >40 μ = 0% by weight | Maximum range of the particle |
| <30 μ = 100% by weight | size distribution curve at |
| >10 μ = 90% by weight | 1 to 5 μ. |

This aluminosilicate was produced comparably to aluminosilicate Im above and has about the same characteristics. In the followwing Table I it is designated by "Al-silicate".

The perborate was a commercial product of the approximate composition:

$NaBO_2 . H_2O_2 . 3 H_2O$, bulk density 830 gm/1.

"TA + 5 EO", "TA + 14 EO", "OCA + 10 EO" are the addition products of 5, 14 and 10 mols of ethylene oxide (EO) to 1 mol of tallow fatty alcohol (TA) (iodine number = 0.5) and oleyl/cetyl alcohol (iodine number = 50).

The "silica" of the premixes was a highly dispersed silicon dioxide with a particle size range of 1 to 12 $\mu$, a liter weight of 90 to 100 gm/1, and a BET-surface area of 300 $m^2$/gm.

The following Table I contains the formulas of some premixes which had been produced in a closed mixer by spraying the liquid Non-ionics on the moving powder mixture.

TABLE I

| Component | % by Weight of Component in the Premix according to Example | | | | | | | | | |
|---|---|---|---|---|---|---|---|---|---|---|
| | V 1 | V 2 | V 3 | V 4 | V 5 | V 6 | V 7 | V 8 | V 9 | V 10 |
| Perborate | — | — | 48.3 | 50.1 | 59.5 | 61.5 | 57.6 | — | 26.0 | — |
| Al-silicate | 85.0 | 75.0 | 34.5 | 32.0 | 17.0 | 23.1 | 18.5 | 80.0 | 31.5 | 63.0 |
| Silica | — | — | — | — | 2.1 | — | 3.1 | — | — | — |
| TA + 5 EO | — | — | 5.2 | 5.4 | 6.4 | 15.4 | 6.4 | 10.0 | 6.0 | 6.0 |
| TA + 14 EO | — | — | 12.0 | 12.5 | — | — | 14.4 | — | 12.5 | 16.0 |
| OCA + 10 EO | 15.0 | 25.0 | — | — | 15.0 | — | — | 10.0 | — | — |
| Tetraacetyl-glycoluril | — | — | — | — | — | — | — | — | 24.0 | 15.0 |

The following examples give formulas of washing agent compositions which contain the premixes according to Examples V 1 to V 10.

The salt constituents contained in the detergents of the examples, such as surfactants in salt form, other organic salts, as well as inorganic salts, were present as sodium salt, unless explicitly stated otherwise.

"ABS" — the salt of alkylbenzenesulfonic acid with 10 to 15, preferably 11 to 13, carbon atoms in the alkyl chain obtained by condensation of straight-chain olefins with benzene and sulfonation of the alkylbenzene thus obtained.

"Olefinsulfonate" — a sulfonate obtained from $\alpha$-olefin mixtures having 12 to 18 carbon atoms by sulfonating with $SO_3$ and hydrolyzing the sulfonation product with sodium hydroxide solution, consisting essentially of alkene sulfonate and hydroxyalkane sulfonate, but also containing small amounts of alkanedisulfonates.

"Fs-ester sulfonate" — sulfonate obtained by sulfonating hydrogenated palm kernel fatty acid methyl ester with $SO_3$.

"Alkanesulfonate" — a sulfonate obtained by sulfoxidation of paraffins having 12 to 18 carbon atoms.

"Soap" — the fatty acid component of a hardened mixture of equal parts by weight of tallow and rape oil fatty acids ($C_{18}$-$C_{22}$, iodine number = 1). "EDTA" — the salt of ethylenediaminetetraacetic acid.

"CMC" — the salt of carboxymethyl cellulose.

The following contains formulations of some washing agent compositions according to the invention. These compositions were obtained from the premixes according to Examples V1 to V 10 by mixing with a powder produced by hot atomization of an aqueous solution containing the listed ingredients. Both the premixes and the finished washing agent compositions showed good powder properties. They were easily pourable, despite their content of oily or pasty Non-ionics.

EXAMPLE W 1

Low-phosphate full range washing agent composition

The preparation was obtained by mixing 59 parts by weight of premix V 3 with 41 parts by weight of a powder obtained by hot atomixation (Tower Powder No. 1) of the following composition:

| | % By Weight |
|---|---|
| ABS | 19.6 |
| Soap | 9.5 |
| EDTA | 0.9 |
| Sodium tripolyphosphate | 28.0 |
| Waterglass (1:3.3) | 14.0 |
| Sodium sulfate | 1.4 |
| Magnesium silicate | 5.6 |
| CMC | 4.2 |
| Balance (water, perfume, optical brighteners) | 16.8 |

The final full range washing agent composition contained the following:

| | % By Weight |
|---|---|
| ABS | 8.03 |
| TA + 5 EO | 3.07 |
| TA + 14 EO | 7.08 |
| Soap | 3.89 |
| Sodium tripolyphosphate | 11.49 |
| EDTA | 0.37 |
| Aluminosilicate | 20.36 |
| Perborate | 28.50 |
| Magnesium silicate | 2.29 |
| Waterglass | 5.74 |
| Sodium sulfate | 0.57 |
| CMC | 1.72 |
| Balance (water, perfume, optical brighteners) | 6.89 |

EXAMPLE W 2

Phosphate-free full range washing agent composition

The preparation was obtained by mixing 57 parts of the premix V 4 with 43 parts by weight of a powder obtained by hot atomization of the following composition (Tower Powder No. 2):

| | % By Weight |
|---|---|
| Fs-ester sulfonate | 7.0 |
| EDTA | 0.6 |
| Sodium citrate | 20.0 |
| Aluminosilicate | 25.3 |
| Waterglass (1:3.3) | 10.2 |
| Sodium sulfate | 13.8 |
| Magnesium silicate | 4.8 |
| CMC | 3.9 |
| Balance (water, perfume, optical brightener) | 14.4 |

The preparation contains 28.5% by weight of sodium perborate. The water-insoluble calcium-binding aluminosilicate was incorporated in the preparation both through the premix and through the Tower Powder in a total amount of 29.2% by weight.

EXAMPLE W 3

Low-phosphate prewashing agent composition

The preparation was obtained by mixing 50 parts by weight of premix V 1 and 50 parts by weight of Tower Powder No. 1 indicated in Example W 1.

EXAMPLE W 4

Phosphate-free main washing agent composition

The preparation was obtained by mixing 60 parts by weight of premix V 2 with 40 parts by weight of Tower Powder No. 2 indicated in Example W 2.

EXAMPLE W 5

The preparation was obtained by mixing 40 parts by weight of premix V 8 with 60 parts by weight of a Tower powder obtained by hot atomization of the following composition:

| Tower Powder No. 3 | % By Weight |
|---|---|
| Alkanesulfonate | 8.0 |
| Soap | 5.0 |
| TA + 14 EO | 5.0 |
| EDTA | 0.5 |
| Sodium tripolyphosphate | 30.0 |
| Waterglass (1:3.3) | 8.0 |
| Sodium carbonate | 8.0 |
| CMC | 3.0 |
| Sodium sulfate | 20.0 |
| Balance (water, perfume, optical brightener) | 12.5 |

EXAMPLE W 6

Phosphate-free prewashing agent composition

The preparation was obtained by mixing 50 parts by weight of premix V 1 and 50 parts by weight of a Tower powder obtained by hot atomization of the following composition:

| Tower Powder No. 4 | % By Weight |
|---|---|
| Olefinsulfonate | 6.0 |
| TA + 5 EO | 4.0 |
| Waterglass (1:3.3) | 10.0 |
| CMC | 3.0 |
| Sodium citrate | 8.0 |
| Sodium sulfate | 58.5 |
| Balance (water, perfume, optical brightener) | 10.5 |

EXAMPLE W 7

Low-phosphate bleaching washing agent composition for 60° C washing

The preparation was obtained by mixing 40 parts by weight of premix V 9 and 60 parts by weight of a Tower powder obtained by hot atomization of the following composition:

| Tower Powder No. 5 | % By Weight |
|---|---|
| ABS | 5.8 |
| Toluene sulfonate | 2.5 |
| Soap | 4.2 |
| EDTA | 0.5 |
| Sodium tripolyphosphate | 25.0 |
| Waterglass (1:3.3) | 8.3 |
| CMC | 3.0 |
| Aluminosilicate | 16.7 |
| Magnesium silicate | 3.0 |
| Balance (sodium sulfate, optical | |

-continued

| Tower Powder No. 5 | % By Weight |
|---|---|
| brightener) | 31.0 |

The preparation contains 10.4% by weight of sodium perborate and 9.6% by weight of tetraacetyl glycoluril as a perborate activator. The water-insoluble calcium binding aluminosilicate was incorporated in the preparation through both the premix and the Tower powder in a total amount of 22.6% by weight.

EXAMPLE W 8

Low-phosphate bleaching washing agent composition for washing at 60° C

The preparation was obtained by mixing 50 parts by weight of premix V 10, 40 parts by weight of Tower Powder No. 1 and 10 parts by weight of sodium perborate.

If it is desired to reduce the foaming power of the washing agent compositions, known foam inhibitors are worked in. This is particularly true for preparations which contain no soap.

The non-tenside foam inhibitors included N-alkylated aminotriazines, optionally containing chlorine, which are obtained by the reaction of 1 mol of cyanuric acid chloride with 2 to 3 mols of a mono- and/or dialkylamine with 6 to 20, preferably 8 to 18, carbon atoms in the alkyl radicals. Similarly effective are propoxylated and/or butoxylated aminotriazines, such as products that are obtained by the addition of from 5 to 10 mols of propylene oxide to 1 mol of melamine and further addition of from 10 to 50 mols of butylene oxide to this propylene-oxide derivative.

Likewise suitable as non-tenside foam inhibitors are water-insoluble organic compounds, like paraffins, or halogenated paraffins with melting points below 100° C, aliphatic $C_{18}$ to $C_{40}$ ketones, as well as aliphatic carboxylic acid esters which contain in the acid or alcohol residue, optionally, also in both of these residues, at least 18 carbon atoms (such as triglycerides or fatty acid/fatty alcohol esters). These compounds can be used to reduce foaming, particularly in combinations of tensides of the sulfate and/or sulfonate type with soaps. Also alkali-stable silicones may be incorporated as non-tenside foam inhibitors.

It has been found unexpectedly that the coating of the crystalline aluminosilicates with the non-ionic surface-active compounds in no way impairs the useful of the aluminosilicates to bind calcium during the washing process. A water-insoluble aluminosilicate utilized as a calcium binding agent must be readily available to calcium ions in the fabric soil and in the water. In washing, the faster the calcium is bound, the more advantageous and, therefore, the calcium binding power is determined over a 15-minute period. One would assume that the coating of the aluminosilicate with liquid non-ionics would create a decrease in the calcium binding power since non-ionics are not rapidly water-soluble, particularly in hot water ordinarily employed for washing.

Completely contrary to this assumption, and totally unexpectedly, it was found that an aluminosilicate premix of an aluminosilicate under the invention having a pore volume of only 0.3 ml/gm is not effected in its calcium binding power in the 15-minute test when coated with non-ionics as shown in the following test.

The Calcium Binding Power Test Method (CBC) as disclosed earlier in this specification was employed:

Aluminosilicate used: 1.06 $Na_2O$ . 1 $Al_2O_3$ . 1.93 $SiO_2$ . 3.8 $H_2O$

CBC: 139 mg CaO/gm AS

Medium particle size: 6.5 $\mu$

Coated material: 80% by weight of the above aluminosilicate and 10% by weight of oleyl/cetyl alcohol + 5 EO + 10% by weight of oleyl/cetyl alcohol + 10 EO.

| Test material | CBC in mg CaO/gm AS | Pore Volume (BET) |
|---|---|---|
| Aluminosilicate uncoated | 139 | 0.3 ml/gm |
| Aluminosilicate coated with non-ionics | 116 | |
| Non-ionics alone | −(20 to 23) | |

This test discloses a slight decrease in the CBC amounting to 23 units in the coated aluminosilicate. This decrease is due to the presence of the non-ionics, as when the non-ionics above were employed in the test a negative value of −23 was found. This demonstrates that no loss in the calcium binding power is found when the crystalline aluminosilicates are coated with non-ionics according to the practice of the invention.

We claim:

1. A pourable washing agent composition consisting of (1) 59 parts by weight of a premix containing 48.3% by weight of $NaBO_2 . H_2O_2 . 3 H_2O$, having a bulk density of 830 gm/l, 34.5% by weight of an aluminosilicate of the composition:

$0.9 Na_2O . Al_2O_3 . 2 SiO_2 . 4 H_2O$ a particle size distribution of 100% by weight below 30 $\mu$, 90% by weight below 10 $\mu$, the maximum range of the particle size distribution curve at 1 to 5 $\mu$ and a calcium binding power of 165 mg CaO/gm AS, as determined at 22° C according to the Calcium Binding Power Test Method set out in the specification, 5.2% by weight of the addition product of 5 mols of ethylene oxide to 1 mol of tallow fatty alcohol (TA + 5 EO) and 12.0% by weight of the addition product of 14 mols of ethylene oxide to 1 mol of tallow fatty alcohol (TA + 14 EO), said premix being produced by spraying said addition products in liquid form onto the moving powder mixture of the remaining ingredients, and (II) 41 parts by weight of a spray-dried powder containing

| | % By Weight |
|---|---|
| [ABS] The sodium slat of alkylbenzenesulfonic acid with 10 to 15 carbon atoms in the alkyl chain (ABS) | 19.6 |
| [Soap] The sodium salt of a hardened mixture of equal parts by weight of tallow and rape oil fatty acids (Soap) | 9.5 |
| [EDTA] The sodium slat of ethylenediaminetetraacetic acid (EDTA) | 0.9 |
| Sodium tripolyphosphate | 28.0 |
| Waterglass (1:3.3) | 14.0 |
| Sodium sulfate | 1.4 |
| Magnesium silicate | 5.6 |
| [CMC] The sodium salt of carboxymethyl cellulose (CMC) | 4.2 |
| Balance (Water, perfume, optical brighteners) | 16.8 |

where the final washing agent composition after mixing said premix and said spray-dried powder was:

| | % By Weight |
|---|---|
| ABS | 8.03 |
| TA + 5 EO | 3.07 |
| TA + 14 EO | 7.08 |
| Soap | 3.89 |
| Sodium tripolyphosphate | 11.49 |
| EDTA | 0.37 |
| Aluminosilicate | 20.36 |
| Perborate | 28.50 |
| Magnesium silicate | 2.29 |
| Waterglass | 5.74 |
| Sodium sulfate | 0.57 |
| CMC | 1.72 |
| Balance (water, perfume, optical brighteners) | 6.89 |

* * * * *